US011742592B2

(12) United States Patent
Fan et al.

(10) Patent No.: US 11,742,592 B2
(45) Date of Patent: Aug. 29, 2023

(54) ARRAYED ANTENNA MODULE

(71) Applicant: INPAQ TECHNOLOGY CO., LTD., Miaoli County (TW)

(72) Inventors: Yang-Hsin Fan, Hsinchu County (TW); Shih-Hsuan Yuan, Miaoli County (TW)

(73) Assignee: INPAQ TECHNOLOGY CO., LTD., Miaoli County (TW)

( * ) Notice: Subject to any disclaimer, the term of this patent is extended or adjusted under 35 U.S.C. 154(b) by 117 days.

(21) Appl. No.: 17/321,482

(22) Filed: May 16, 2021

(65) Prior Publication Data

US 2022/0224020 A1 Jul. 14, 2022

(30) Foreign Application Priority Data

Jan. 8, 2021 (TW) ..... 110200230

(51) Int. Cl.

| | |
|---|---|
| ***H01Q 21/06*** | (2006.01) |
| ***H01Q 1/12*** | (2006.01) |
| ***H01Q 9/16*** | (2006.01) |
| ***H01Q 9/04*** | (2006.01) |

(52) U.S. Cl.

CPC ..... *H01Q 21/065* (2013.01); *H01Q 1/1207* (2013.01); *H01Q 9/16* (2013.01); *H01Q 21/062* (2013.01); *H01Q 9/0414* (2013.01)

(58) Field of Classification Search

CPC ..... H01Q 9/0414; H01Q 21/065

See application file for complete search history.

(56) References Cited

U.S. PATENT DOCUMENTS

| | | | | |
|---|---|---|---|---|
| 7,616,159 | B2 * | 11/2009 | Fu | H01Q 21/065 343/815 |
| 2003/0189516 | A1 * | 10/2003 | Olson | H01Q 9/0414 343/700 MS |
| 2021/0013623 | A1 * | 1/2021 | Wang | H01Q 21/28 |

* cited by examiner

*Primary Examiner* — Graham P Smith
*Assistant Examiner* — Amal Patel
(74) *Attorney, Agent, or Firm* — Li & Cai Intellectual Property Office

(57) ABSTRACT

An arrayed antenna module includes a first antenna group, a second antenna group, a front conductive connecting assembly and a rear conductive connecting assembly. The first antenna group includes a plurality of first antenna structures arranged in parallel thereon. The second antenna group includes a plurality of second antenna structures arranged in parallel thereon. The front conductive connecting assembly includes a first front conductive connecting element electrically connected to the first antenna group, and a second front conductive connecting element electrically connected to the second antenna group. The rear conductive connecting assembly includes a first rear conductive connecting element electrically connected to the first antenna group, and a second rear conductive connecting element electrically connected to the second antenna group. Therefore, the arrayed antenna module provided can be applied to a portable electronic device so as to receive or transmit signals.

5 Claims, 10 Drawing Sheets

ARRAYED ANTENNA MODULE

CROSS-REFERENCE TO RELATED PATENT APPLICATION

This application claims the benefit of priority to Taiwan Patent Application No. 110200230, filed on Jan. 8, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna module, and more particularly to an arrayed antenna module.

BACKGROUND OF THE DISCLOSURE

In the related art, a conventional wireless module can be used to wirelessly transmit signals, so that an electronic device can use the wireless module to receive or emit the signals. However, the conventional wireless module still has room for improvement.

SUMMARY OF THE DISCLOSURE

In response to the above-referenced technical inadequacy, the present disclosure provides an arrayed antenna module.

In one aspect, the present disclosure provides an arrayed antenna module including a carrier substrate, a first antenna group, a second antenna group, a front conductive connecting assembly and a rear conductive connecting assembly. The first antenna group includes a plurality of first antenna structures disposed on the carrier substrate, a first left conductive connecting element electrically connected to the first antenna structures, and a first right conductive connecting element electrically connected to the first antenna structures. The second antenna group includes a plurality of second antenna structures disposed on the carrier substrate, a second left conductive connecting element electrically connected to the second antenna structures, and a second right conductive connecting element electrically connected to the second antenna structures. The front conductive connecting assembly includes a first front conductive connecting element electrically connected to the first left conductive connecting element, a second front conductive connecting element electrically connected to the second left conductive connecting element, and a front signal feeding element electrically connected between the first front conductive connecting element and the second front conductive connecting element. The rear conductive connecting assembly includes a first rear conductive connecting element electrically connected to the first right conductive connecting element, a second rear conductive connecting element electrically connected to the second right conductive connecting element, and a rear signal feeding element electrically connected between the first rear conductive connecting element and the second rear conductive connecting element.

The first antenna structure includes a first support element disposed on the carrier substrate, a first upper plate supported by the first support element, and a first lower plate supported by the first support element, the first upper plate and the first lower plate are separate from each other, and the first lower plate is connected between the first left conductive connecting element and the first right conductive connecting element. The second antenna structure includes a second support element disposed on the carrier substrate, a second upper plate supported by the second support element, and a second lower plate supported by the second support element, the second upper plate and the second lower plate are separate from each other, and the second lower plate is connected between the second left conductive connecting element and the second right conductive connecting element.

In another aspect, the present disclosure provides an arrayed antenna module including a first antenna group, a second antenna group, a front conductive connecting assembly and a rear conductive connecting assembly. The first antenna group includes a plurality of first antenna structures, a first left conductive connecting element electrically connected to the first antenna structures, and a first right conductive connecting element electrically connected to the first antenna structures. The second antenna group includes a plurality of second antenna structures, a second left conductive connecting element electrically connected to the second antenna structures, and a second right conductive connecting element electrically connected to the second antenna structures. The front conductive connecting assembly includes a first front conductive connecting element electrically connected to the first left conductive connecting element, and a second front conductive connecting element electrically connected to the second left conductive connecting element. The rear conductive connecting assembly includes a first rear conductive connecting element electrically connected to the first right conductive connecting element, and a second rear conductive connecting element electrically connected to the second right conductive connecting element.

In yet another aspect, the present disclosure provides an arrayed antenna module including a first antenna group, a second antenna group, a front conductive connecting assembly and a rear conductive connecting assembly. The first antenna group includes a plurality of first antenna structures arranged in parallel thereon. The second antenna group includes a plurality of second antenna structures arranged in parallel thereon. The front conductive connecting assembly includes a first front conductive connecting element electrically connected to the first antenna group, and a second front conductive connecting element electrically connected to the second antenna group. The rear conductive connecting assembly includes a first rear conductive connecting element electrically connected to the first antenna group, and a second rear conductive connecting element electrically connected to the second antenna group.

Therefore, by virtue of "the first antenna group including a plurality of first antenna structures arranged in parallel thereon", "the second antenna group including a plurality of second antenna structures arranged in parallel thereon", "the front conductive connecting assembly including a first front conductive connecting element electrically connected to the first antenna group, and a second front conductive connecting element electrically connected to the second antenna group" and "the rear conductive connecting assembly including a first rear conductive connecting element electrically connected to the first antenna group, and a second rear conductive connecting element electrically connected to the second antenna group", the arrayed antenna module provided by the present disclosure can be applied to a portable electronic device so as to receive or transmit signals.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
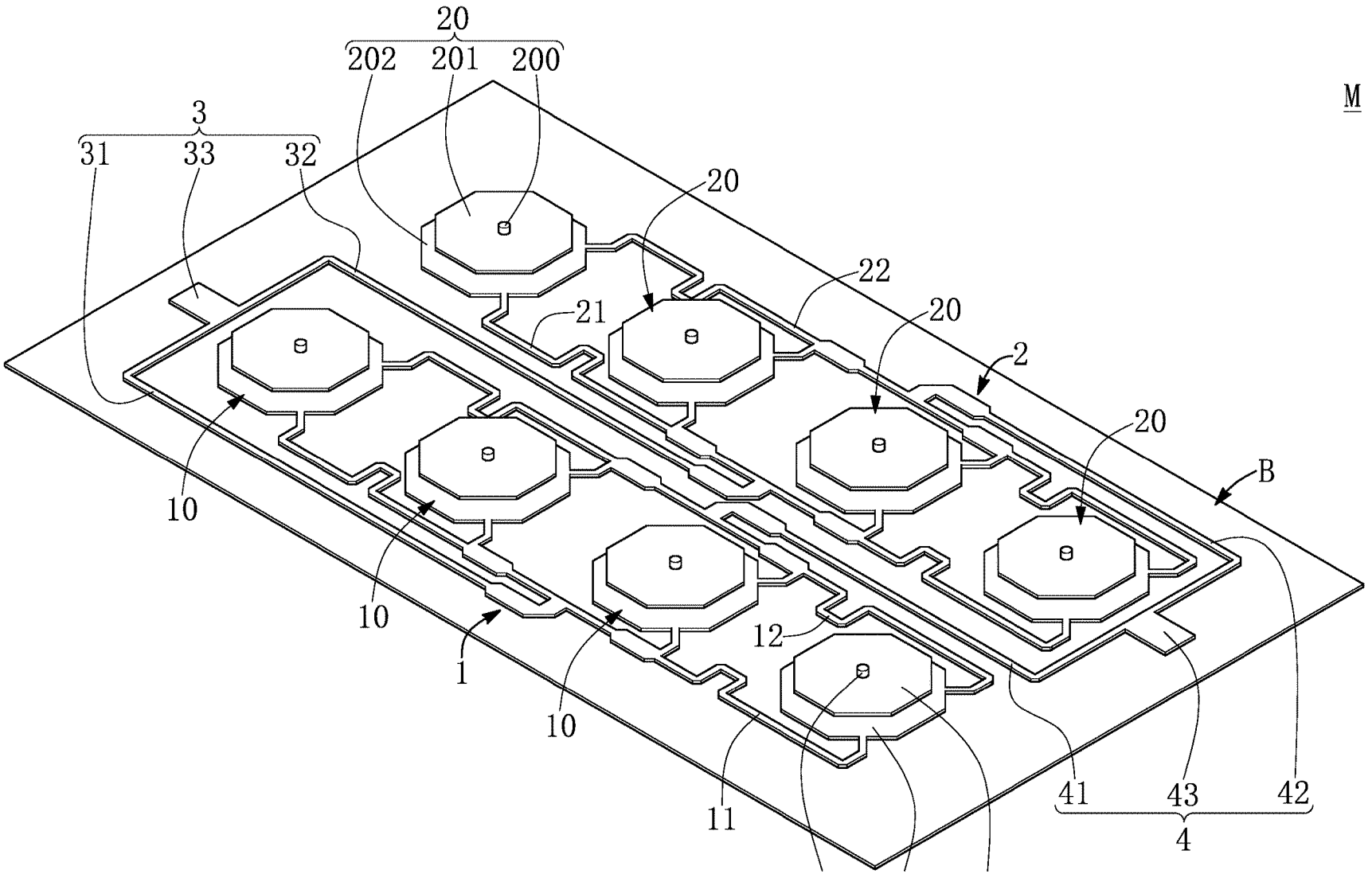
FIG. 1 shows a schematic perspective view of an arrayed antenna module according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 12, the present disclosure provides an arrayed antenna module M including a first antenna group 1, a second antenna group 2, a front conductive connecting assembly 3 and a rear conductive connecting assembly 4. More particularly, the first antenna group 1 includes a plurality of first antenna structures 10 arranged in parallel thereon, and the second antenna group 2 includes a plurality of second antenna structures 20 arranged in parallel thereon. In addition, the front conductive connecting assembly 3 includes a first front conductive connecting element 31 electrically connected to the first antenna group 1, and a second front conductive connecting element 32 electrically connected to the second antenna group 2, and the rear conductive connecting assembly 4 includes a first rear conductive connecting element 41 electrically connected to the first antenna group 1, and a second rear conductive connecting element 42 electrically connected to the second antenna group 2. Therefore, the arrayed antenna module M provided by the present disclosure can be applied to a portable electronic device (not shown, such as a wireless access point) so as to receive or transmit (or emit) signals.

First Embodiment

Referring to FIG. 1 to FIG. 9, a first embodiment of the present disclosure provides an arrayed antenna module M including a carrier substrate B, a first antenna group 1, a second antenna group 2, a front conductive connecting assembly 3 and a rear conductive connecting assembly 4. For example, the carrier substrate B can serve as a grounding substrate electrically connected to a ground, and there can be no antenna circuit layout configured on a bottom surface of the carrier substrate B. In addition, the first antenna group 1, the second antenna group 2, the front conductive connecting assembly 3 and the rear conductive connecting assembly 4 can be made of conductive material, and the first antenna group 1, the second antenna group 2, the front conductive connecting assembly 3 and the rear conductive connecting assembly 4 are disposed on a top surface of the carrier substrate B. In addition, the arrayed antenna module M can be a dual-polarised arrayed antenna module that is able to receive and transmit 5G signals. However, the aforementioned description is merely an example and is not meant to limit the scope of the present disclosure.

Figure 2:
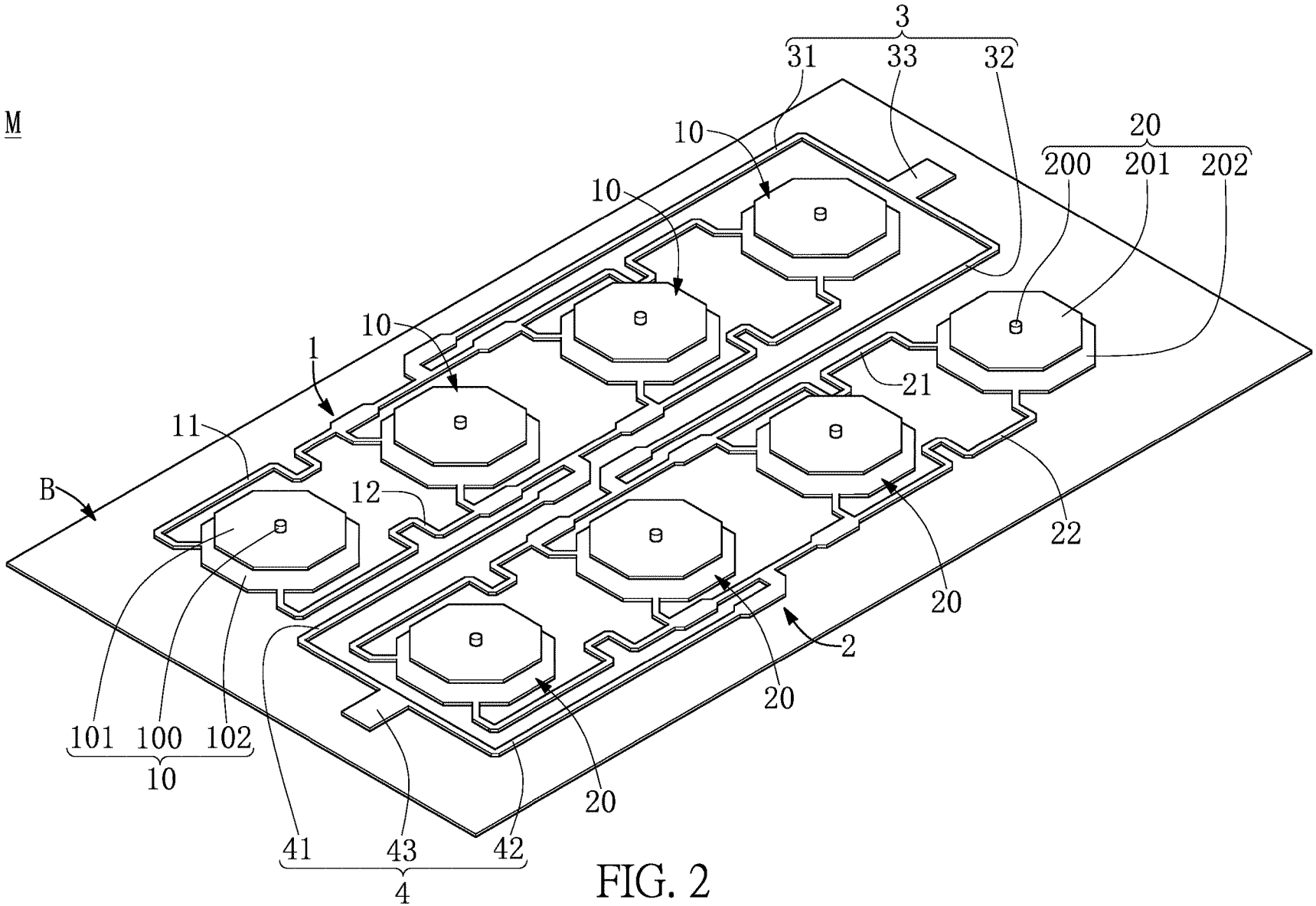
FIG. 2 shows another schematic perspective view of the arrayed antenna module according to the first embodiment of the present disclosure.
Figure 3:
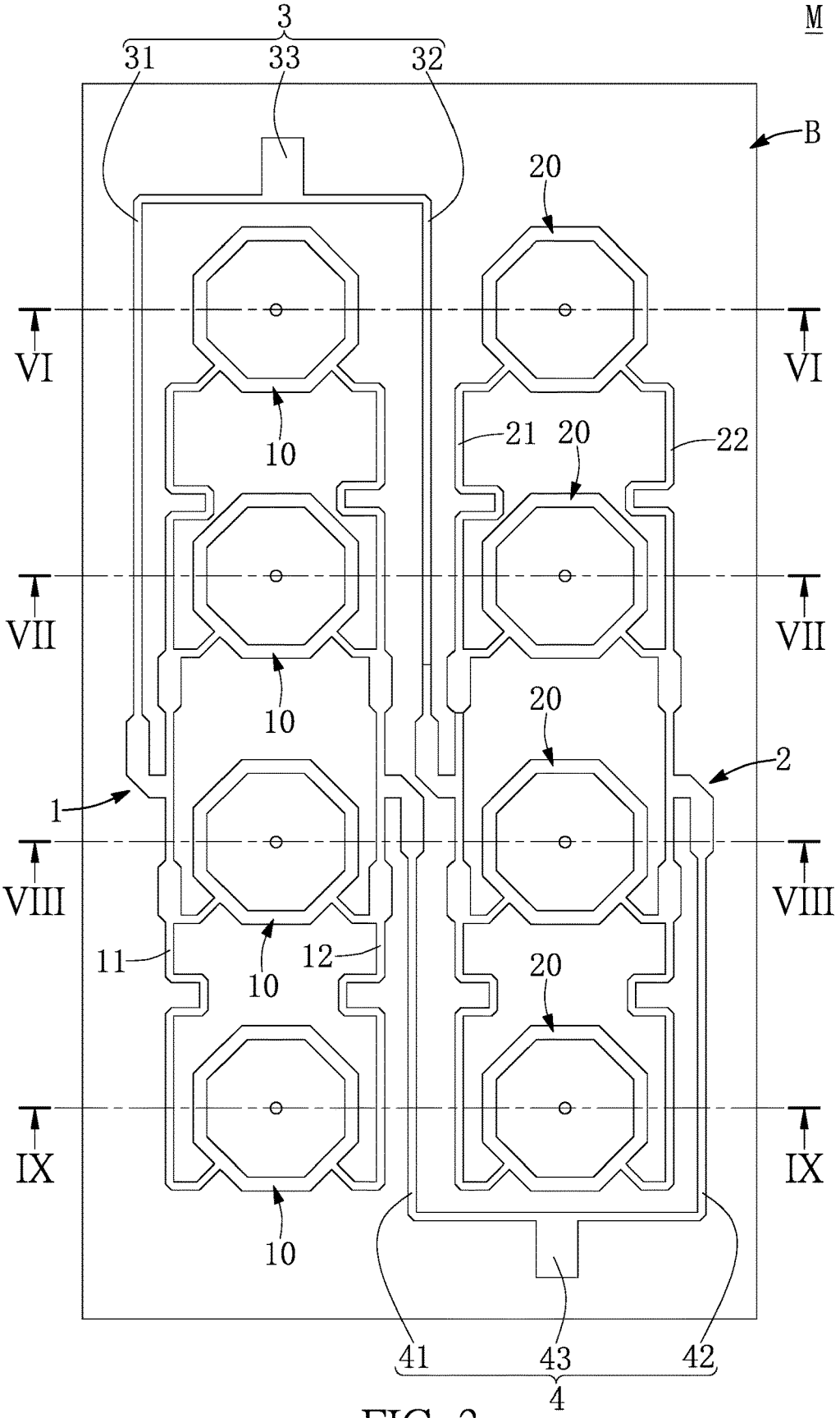
FIG. 3 shows a schematic top view of the arrayed antenna module according to the first embodiment of the present disclosure.

Firstly, referring to FIG. 1 to FIG. 3, the first antenna group 1 includes a plurality of first antenna structures 10 disposed on the carrier substrate B, a first left conductive connecting element 11 electrically connected to the first antenna structures 10, and a first right conductive connecting element 12 electrically connected to the first antenna structures 10. More particularly, the first antenna structure 10 includes a first support element 100 disposed on the carrier substrate B, a first upper plate 101 supported by the first support element 100, and a first lower plate 102 supported by the first support element 100. In addition, the first upper plate 101 and the first lower plate 102 are separate from each other, and the first lower plate 102 is disposed between the carrier substrate B and the first upper plate 101. Moreover, the first lower plate 102 is connected between the first left conductive connecting element 11 and the first right conductive connecting element 12, and the first lower plate 102, the first left conductive connecting element 11 and the first right conductive connecting element 12 are disposed on the same plane.

Furthermore, referring to FIG. 1 to FIG. 3, the second antenna group 2 includes a plurality of second antenna structures 20 disposed on the carrier substrate B, a second left conductive connecting element 21 electrically connected to the second antenna structures 20, and a second right conductive connecting element 22 electrically connected to the second antenna structures 20. More particularly, the second antenna structure 20 includes a second support element 200 disposed on the carrier substrate B, a second upper plate 201 supported by the second support element 200, and a second lower plate 202 supported by the second support element 200. In addition, the second upper plate 201 and the second lower plate 202 are separate from each other, and the second lower plate 202 is disposed between the carrier substrate B and the second upper plate 201. Moreover, the second lower plate 202 is connected between the second left conductive connecting element 21 and the second right conductive connecting element 22, and the second lower plate 202, the second left conductive connecting element 21 and the second right conductive connecting element 22 are disposed on the same plane.

Moreover, referring to FIG. 1 to FIG. 3, the front conductive connecting assembly 3 includes a first front conductive connecting element 31 electrically connected to the first left conductive connecting element 11, a second front conductive connecting element 32 electrically connected to the second left conductive connecting element 21, and a front signal feeding element 33 electrically connected between the first front conductive connecting element 31 and the second front conductive connecting element 32. In addition, the rear conductive connecting assembly 4 includes a first rear conductive connecting element 41 electrically connected to the first right conductive connecting element 12, a second rear conductive connecting element 42 electrically connected to the second right conductive connecting element 22, and a rear signal feeding element 43 electrically connected between the first rear conductive connecting element 41 and the second rear conductive connecting element 42. More particularly, the front signal feeding element 33 and the rear signal feeding element 43 are respectively disposed at two opposite positions of the arrayed antenna module M, and two signal feeding wires (not shown) are respectively electrically connected to the front signal feeding element 33 and the rear signal feeding element 43 for receiving feeding signals. It should be noted that signals can be transmitted along the front conductive connecting assembly 3 and the rear conductive connecting assembly 4, and a transmitting direction of the signals along the first front conductive connecting element 31 (or the second front conductive connecting element 32) is exactly opposite to a transmitting direction of the signals along the first rear conductive connecting element 41 (or the second rear conductive connecting element 42).

Figure 4:
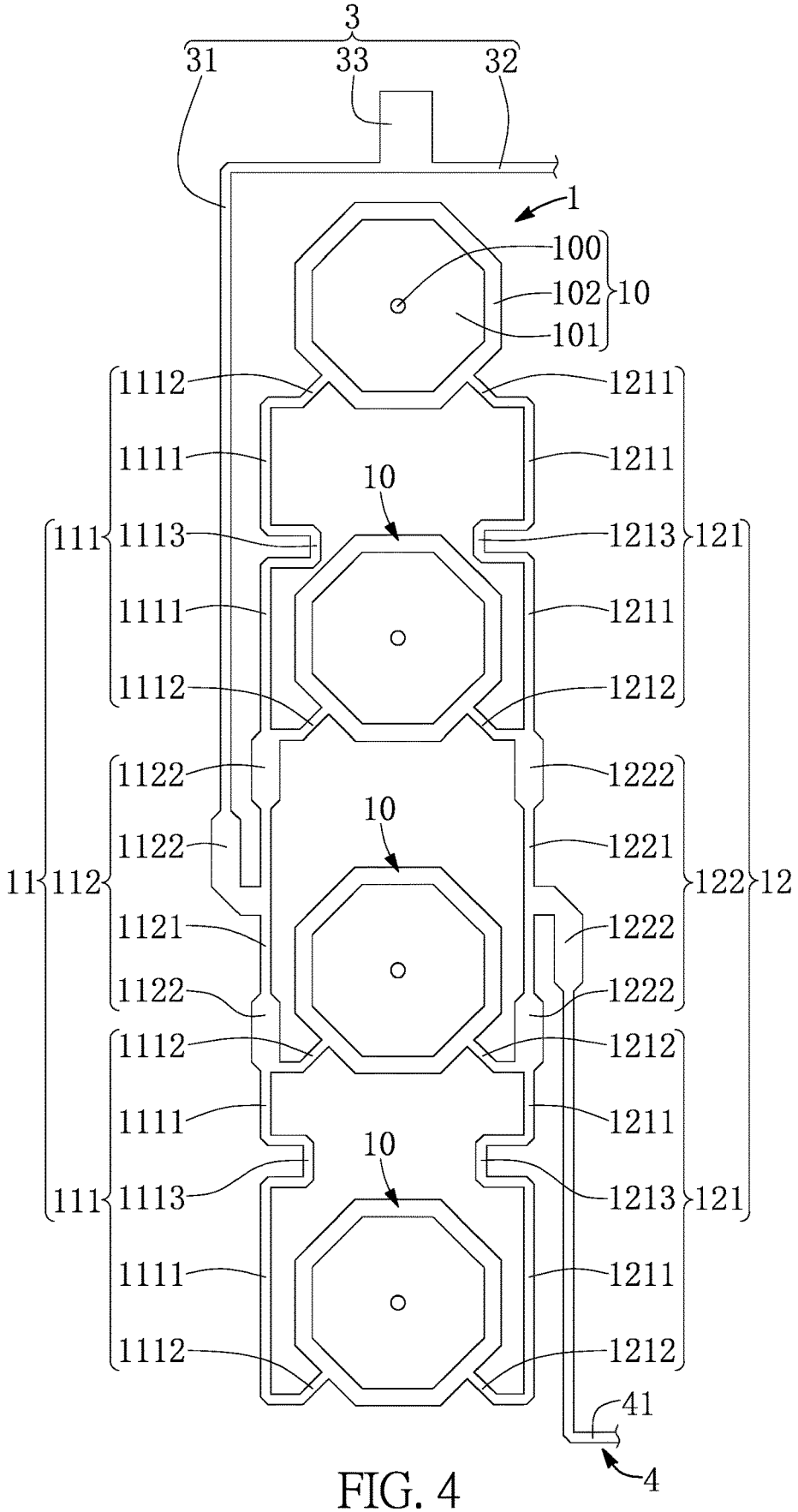
FIG. 4 shows a schematic top view of a first antenna group of the arrayed antenna module electrically connected between a front conductive connecting assembly and a rear conductive connecting assembly according to the first embodiment of the present disclosure.
Figure 5:
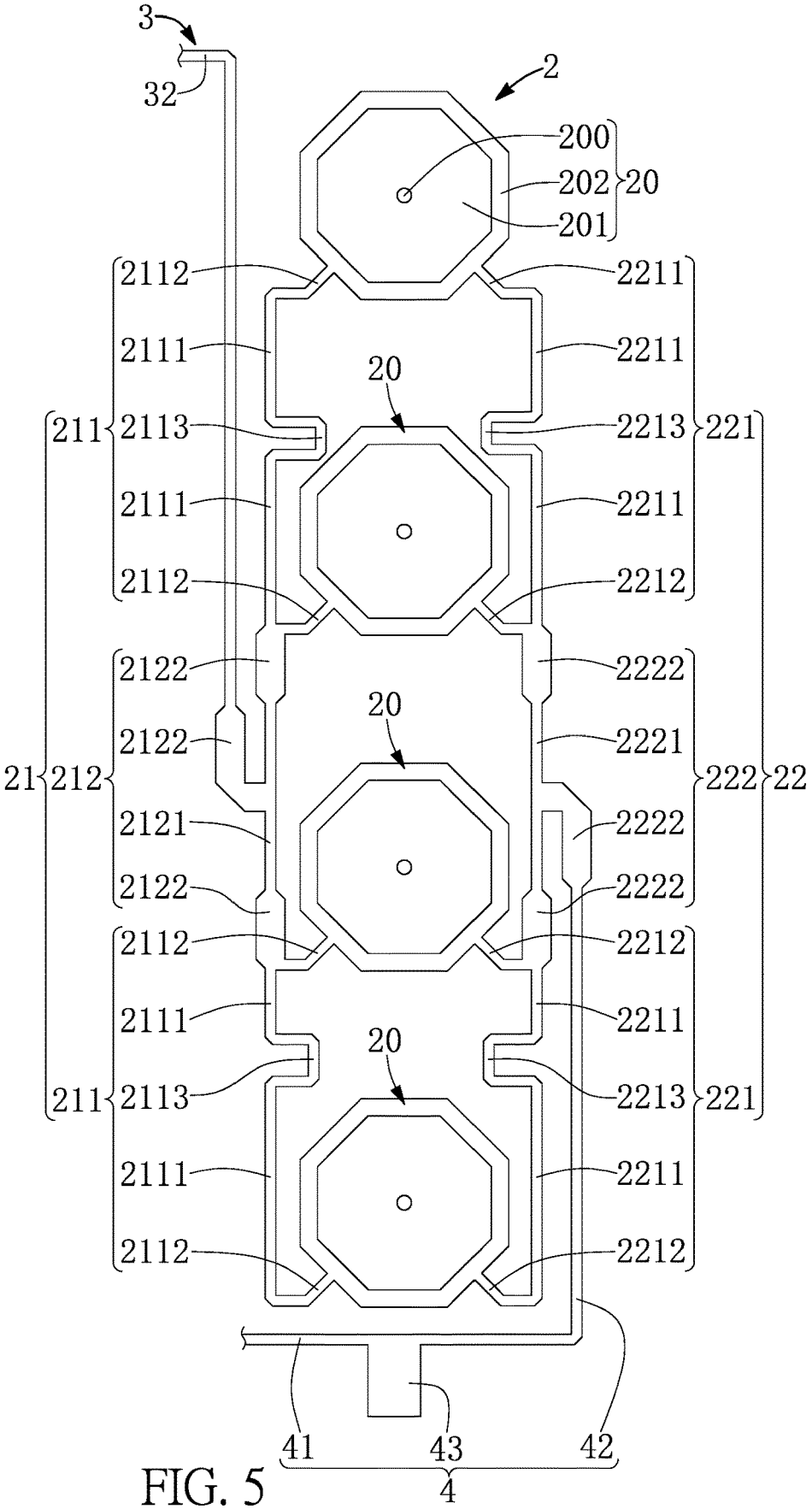
FIG. 5 shows a schematic top view of a second antenna group of the arrayed antenna module electrically connected between the front conductive connecting assembly and the rear conductive connecting assembly according to the first embodiment of the present disclosure.
Figure 6:
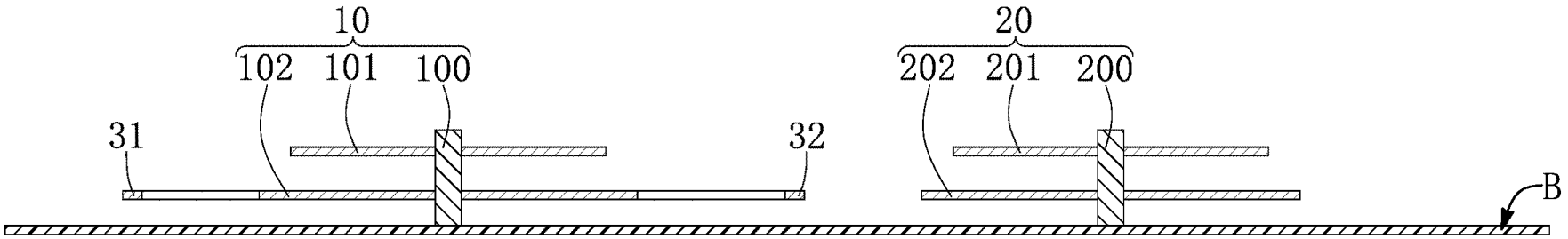
FIG. 6 is a schematic cross-sectional view taken along line VI-VI of FIG. 3.
Figure 7:
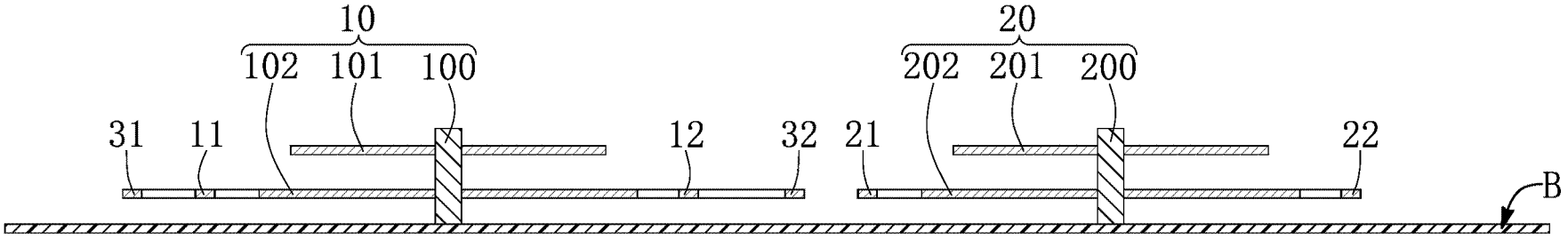
FIG. 7 is a schematic cross-sectional view taken along line VII-VII of FIG. 3.
Figure 8:
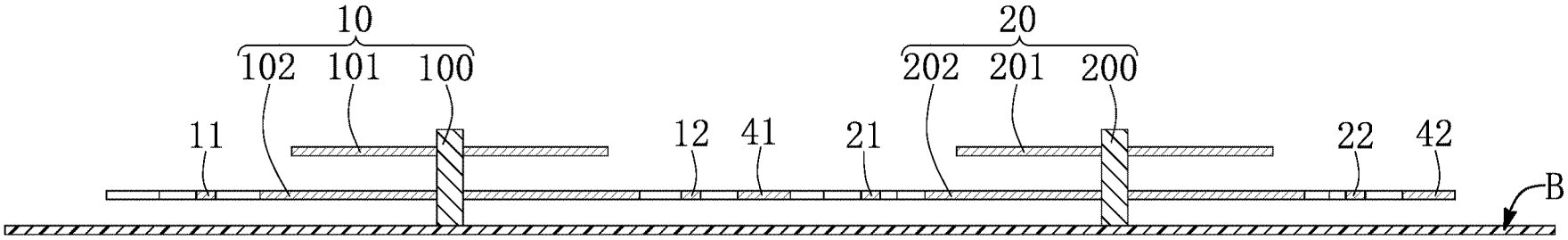
FIG. 8 is a schematic cross-sectional view taken along line VIII-VIII of FIG. 3.
Figure 9:
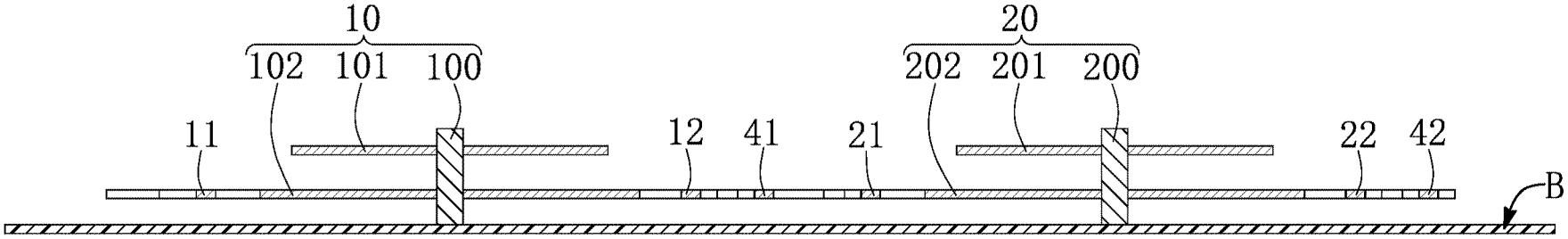
FIG. 9 is a schematic cross-sectional view taken along line IX-IX of FIG. 3.

More particularly, referring to FIG. 3 to FIG. 5, the first left conductive connecting element 11 includes two first left conductive portions 111 and a first left three-way connecting portion 112. One of the two first left conductive portions 111 is electrically connected between two of the first antenna structures 10, and another one of the two first left conductive portions 111 is electrically connected between another two of the first antenna structures 10. The first left three-way connecting portion 112 is electrically connected between the two first left conductive portions 111 and the first front conductive connecting element 31, so that the first antenna structures 10 can electrically connect to the first front conductive connecting element 31 of the front conductive connecting assembly 3 by cooperation of the two first left conductive portions 111 and the first left three-way connecting portion 112. Moreover, the first right conductive connecting element 12 includes two first right conductive portions 121 and a first right three-way connecting portion 122. One of the two first right conductive portions 121 is electrically connected between the two of the first antenna structures 10, and another one of the two first right conductive portions 121 is electrically connected between the another two of the first antenna structures 10. The first right three-way connecting portion 122 is electrically connected between the two first right conductive portions 121 and the first rear conductive connecting element 41, so that the first antenna structures 10 can electrically connect to the first rear conductive connecting element 41 of the rear conductive connecting assembly 4 by cooperation of the two first right conductive portions 121 and the first right three-way connecting portion 122.

More particularly, referring to FIG. 3 to FIG. 5, each of the first left conductive portions 111 includes two first left straight sections 1111, two first left bent sections 1112 and a first left offset section 1113. The two first left bent sections 1112 are respectively connected to the two adjacent first antenna structures 10, one of the two first left straight sections 1111 is connected between the first left offset section 1113 and one of the two first left bent sections 1112, and another one of the two first left straight sections 1111 is connected between the first left offset section 1113 and another one of the two first left bent sections 1112. Moreover, each of the first right conductive portions 121 includes two first right straight sections 1211, two first right bent sections 1212 and a first right offset section 1213. The two first right bent sections 1212 are respectively connected to the two adjacent first antenna structures 10, one of the two first right straight sections 1211 is connected between the first right offset section 1213 and one of the two first right bent sections 1212, and another one of the two first right straight sections 1211 is connected between the first right offset section 1213 and another one of the two first right bent sections 1212. It should be noted that a bent angle of the first left bent section 1112 and a bent angle of the first right bent sections 1212 relative to the first antenna structure 10 are changeable or adjustable according to different requirements before manufacturing of the arrayed antenna module M is complete, and an inward offset of the first left offset section 1113 from (or relative to) the first left straight section 1111 and an inward offset of the first right offset section 1213 from (or relative to) the first right straight section 1211 are changeable or adjustable according to different requirements before manufacturing of the arrayed antenna module M is complete.

More particularly, referring to FIG. 3 to FIG. 5, the first left three-way connecting portion 112 includes a first left three-way straight section 1121 and three first left widened sections 1122, and each of the three first left widened sections 1122 has a width larger than that of the first left three-way straight section 1121. One of the three first left widened sections 1122 is connected to the first left three-way straight section 1121 and the first front conductive connecting element 31, another one of the three first left widened sections 1122 is connected to the first left three-way straight section 1121 and one of the two first right conductive portions 121, and a remaining one of the three first left widened sections 1122 is connected to the first left three-way straight section 1121 and another one of the two first right conductive portions 121. Moreover, the first right three-way connecting portion 122 includes a first right three-way straight section 1221 and three first right widened sections 1222, and each of the three first right widened sections 1222 has a width larger than that of the first right three-way straight section 1221. One of the three first right widened sections 1222 is connected to the first right three-way straight section 1221 and the first front conductive connecting element 31, another one of the three first right widened sections 1222 is connected to the first right three-way straight section 1221 and one of the two first right conductive portions 121, and a remaining one of the three first right widened sections 1222 is connected to the first right three-way straight section 1221 and another one of the two first right conductive portions 121. It should be noted that a width of the first left widened section 1122 and a width of the first right widened section 1222 are changeable or adjustable according to different requirements before manufacturing of the arrayed antenna module M is complete.

More particularly, referring to FIG. 3 to FIG. 5, the second left conductive connecting element 21 includes two second left conductive portions 211 and a second left three-way connecting portion 212. One of the two second left conductive portions 211 is electrically connected between two of the second antenna structures 20, and another one of the two second left conductive portions 211 is electrically connected between another two of the second antenna structures 20. The second left three-way connecting portion 212 is electrically connected between the two second left conductive portions 211 and the second front conductive connecting element 32, so that the second antenna structures 20 can electrically connect to the second front conductive connecting element 32 of the front conductive connecting assembly 3 by cooperation of the two second left conductive portions 211 and the second left three-way connecting portion 212. Moreover, the second right conductive connecting element 22 includes two second right conductive portions 221 and a second right three-way connecting portion 222. One of the two second right conductive portions 221 is electrically connected between the two of the second antenna structures 20, and another one of the two second right conductive portions 221 is electrically connected between the another two of the second antenna structures 20. The second right three-way connecting portion 222 is electrically connected between the two second right conductive portions 221 and the second rear conductive connecting element 42, so that the second antenna structures 20 can electrically connect to the second rear conductive connecting element 42 of the rear conductive connecting assembly 4 by cooperation of the two second right conductive portions 221 and the second right three-way connecting portion 222.

More particularly, referring to FIG. 3 to FIG. 5, each of the second left conductive portions 211 includes two second left straight sections 2111, two second left bent sections 2112 and a second left offset section 2113. The two second left bent sections 2112 are respectively connected to two adjacent ones of the second antenna structures 20, one of the two second left straight sections 2111 is connected between the second left offset section 2113 and one of the two second left bent sections 2112, and another one of the two second left straight sections 2111 is connected between the second left offset section 2113 and another one of the two second left bent sections 2112. Moreover, each of the second right conductive portions 221 includes two second right straight sections 2211, two second right bent sections 2212 and a second right offset section 2213. The two second right bent sections 2212 are respectively connected to another two adjacent ones of the second antenna structures 20, one of the two second right straight sections 2211 is connected between the second right offset section 2213 and one of the two second right bent sections 2212, and another one of the two second right straight sections 2211 is connected between the second right offset section 2213 and another one of the two second right bent sections 2212. It should be noted that a bent angle of the second left bent section 2112 and a bent angle of the second right bent sections 2212 relative to the second antenna structure 10 are changeable or adjustable according to different requirements before manufacturing of the arrayed antenna module M is complete, and an inward offset of second left offset section 2113 from (or relative to) the second left straight section 2111 and an inward offset of the second right offset section 2213 from (or relative to) the second right straight section 2211 are changeable or adjustable according to different requirements before manufacturing of the arrayed antenna module M is complete.

More particularly, referring to FIG. 3 to FIG. 5, the second left three-way connecting portion 212 includes a second left three-way straight section 2121 and three second left widened sections 2122, and each of the three second left widened sections 2122 has a width larger than that of the second left three-way straight section 2121. One of the three second left widened sections 2122 is connected to the second left three-way straight section 2121 and the second front conductive connecting element 32, another one of the three second left widened sections 2122 is connected to the second left three-way straight section 2121 and one of the two second right conductive portions 221, and a remaining one of the three second left widened sections 2122 is connected to the second left three-way straight section 2121 and another one of the two second right conductive portions 221. Moreover, the second right three-way connecting portion 222 includes a second right three-way straight section 2221 and three second right widened sections 2222, and each of the three second right widened sections 2222 has a width larger than that of the second right three-way straight section 2221. One of the three second right widened sections 2222 is connected to the second right three-way straight section 2221 and the second front conductive connecting element 32, another one of the three second right widened sections 2222 is connected to the second right three-way straight section 2221 and one of the two second right conductive portions 221, and a remaining one of the three second right widened sections 2222 is connected to the second right three-way straight section 2221 and another one of the two second right conductive portions 221. It should be noted that a width of the second left widened section 2122 and a width of the second right widened section 2222 are changeable or adjustable according to different requirements before manufacturing of the arrayed antenna module M is complete.

For example, referring to FIG. 6 to FIG. 9, the first lower plate 102, the first left conductive connecting element 11, the first right conductive connecting element 12, the second lower plate 202, the second left conductive connecting element 21, the second right conductive connecting element 22, the front conductive connecting assembly 3 and the rear conductive connecting assembly 4 can be disposed on the same plane and integrally formed as a single plate-shaped component, and the single plate-shaped component can be structurally supported by the first support element 100 and the second support element 200. However, the aforementioned description is merely an example and is not meant to limit the scope of the present disclosure.

Second Embodiment

Figure 10:
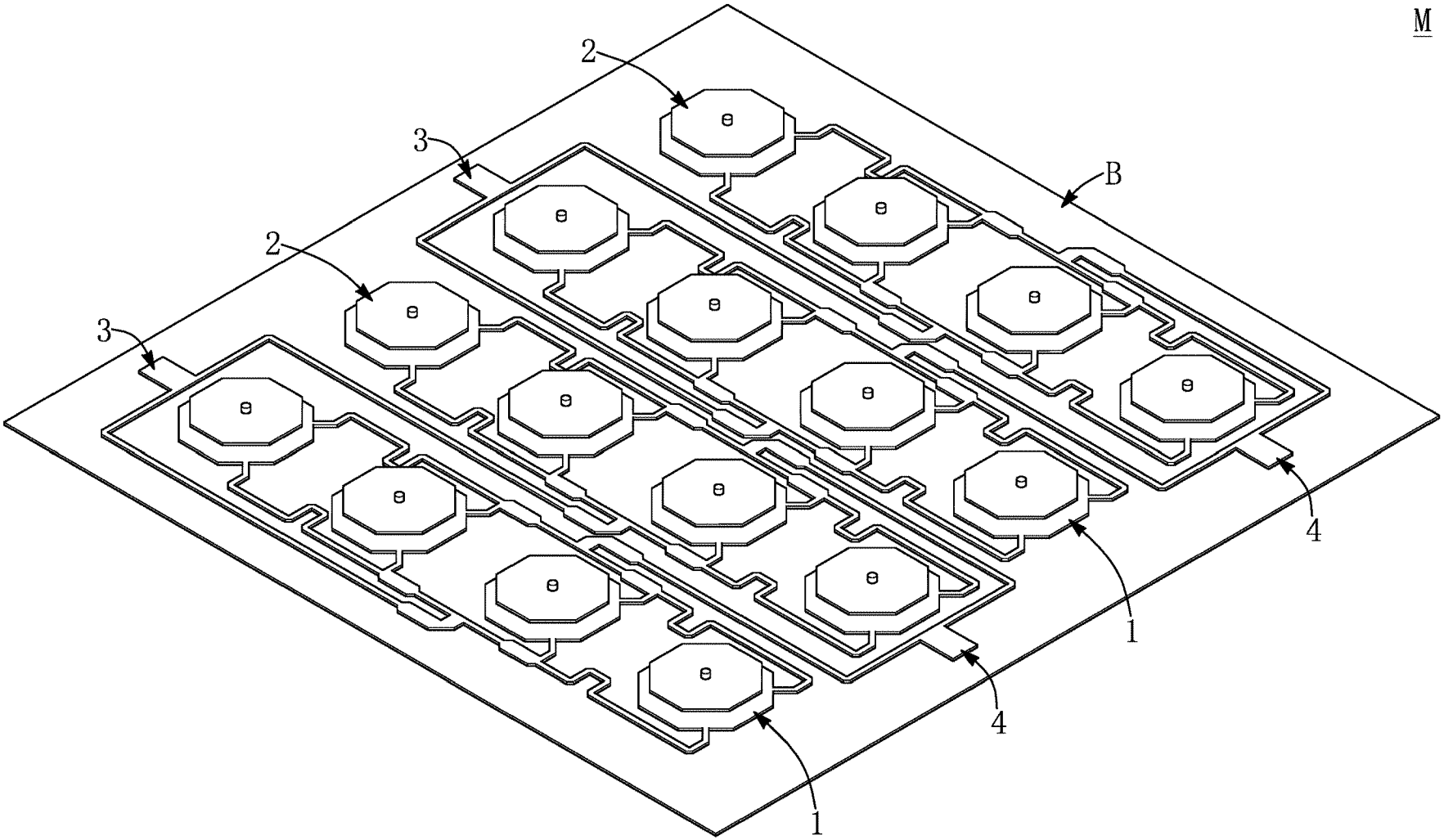
FIG. 10 shows a schematic perspective view of an arrayed antenna module according to a second embodiment of the present disclosure.
Figure 11:
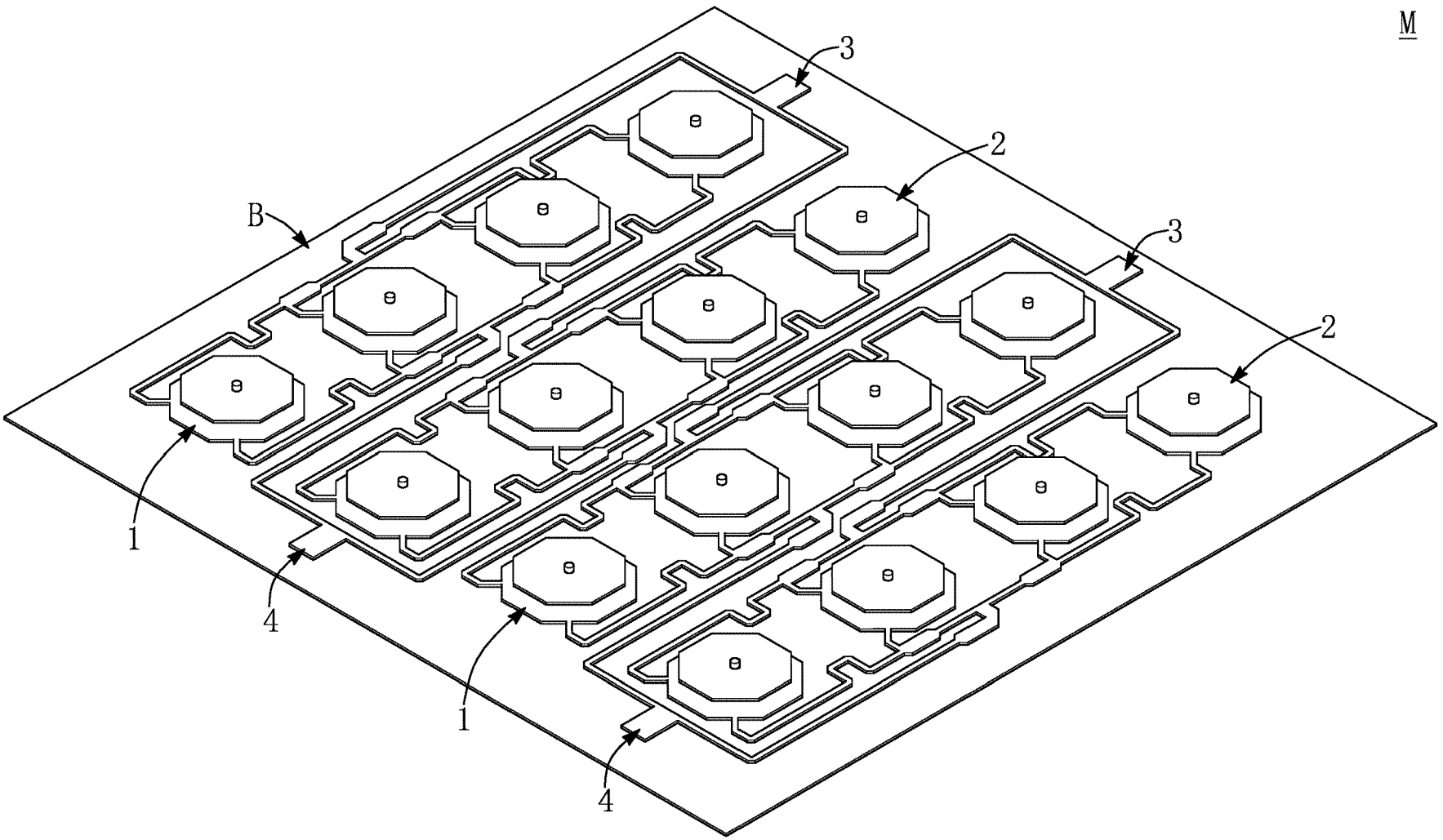
FIG. 11 shows another schematic perspective view of the arrayed antenna module according to the second embodiment of the present disclosure.
Figure 12:
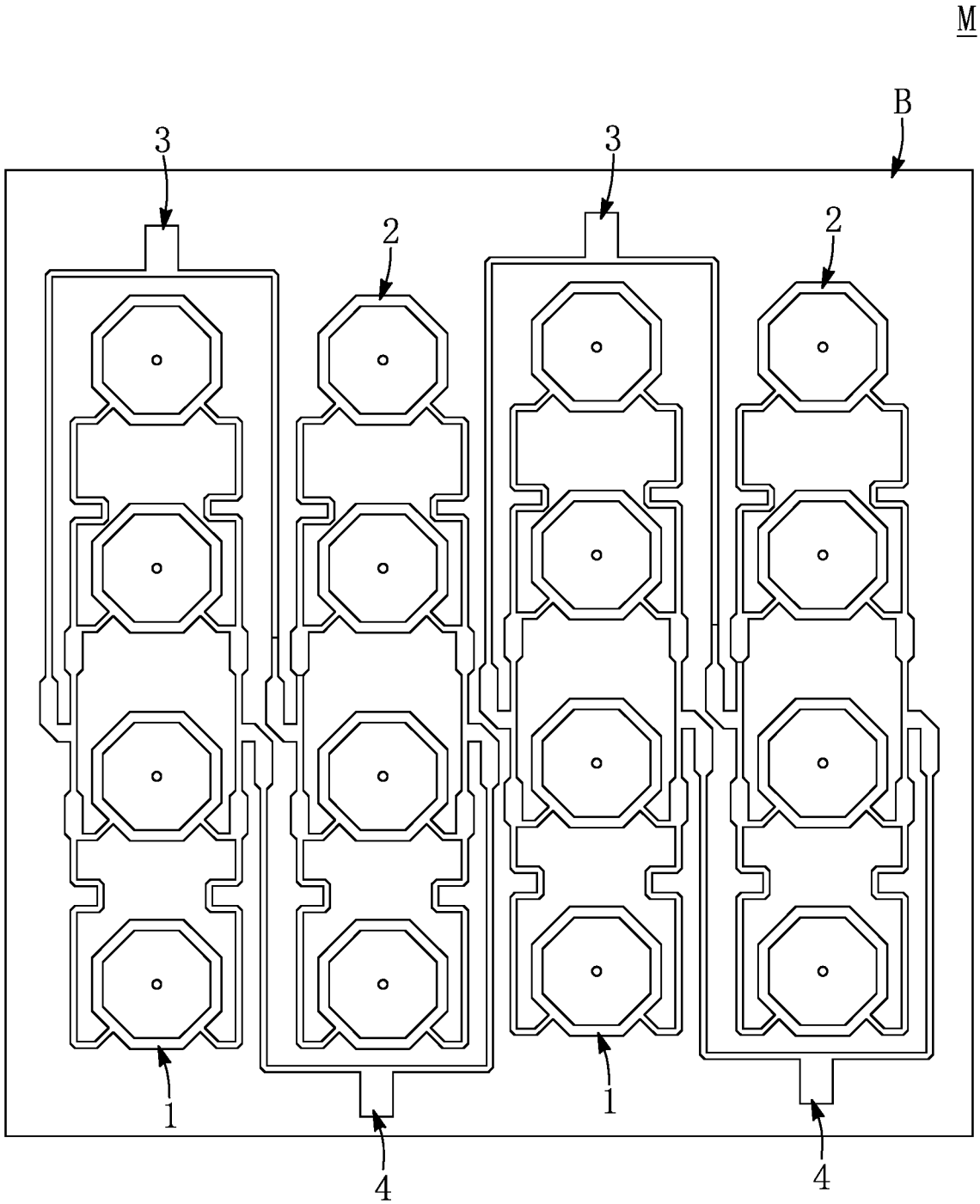
FIG. 12 shows a schematic top view of the arrayed antenna module according to the second embodiment of the present disclosure.

Referring to FIG. 10 to FIG. 12, a second embodiment of the present disclosure provides an arrayed antenna module M. Comparing FIG. 10 with FIG. 1, comparing FIG. 11 with FIG. 2, and comparing FIG. 12 with FIG. 3, the difference between the second embodiment and the first embodiment is as follows: in the second embodiment, the arrayed antenna module M includes two first antenna groups 1, two second antenna groups 2, two front conductive connecting assemblies 3 and two rear conductive connecting assemblies 4. That is to say, the number of the first antenna groups 1, the second antenna group 2, the front conductive connecting assembly 3 and the rear conductive connecting assembly 4 can be changeable or adjustable according to different requirements.

Beneficial Effects of the Embodiments

In conclusion, by virtue of "the first antenna group 1 includes a plurality of first antenna structures 10 arranged in parallel thereon", "the second antenna group 2 includes a plurality of second antenna structures 20 arranged in parallel thereon", "the front conductive connecting assembly 3 includes a first front conductive connecting element 31 electrically connected to the first antenna group 1, and a second front conductive connecting element 32 electrically connected to the second antenna group 2" and "the rear conductive connecting assembly 4 includes a first rear conductive connecting element 41 electrically connected to the first antenna group 1, and a second rear conductive connecting element 42 electrically connected to the second antenna group 2", the arrayed antenna module M provided by the present disclosure can be applied to a portable electronic device so as to receive or transmit signals.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An arrayed antenna module, comprising:

a carrier substrate;

a first antenna group including a plurality of first antenna structures disposed on the carrier substrate, a first left conductive connecting element electrically connected to the first antenna structures, and a first right conductive connecting element electrically connected to the first antenna structures;

a second antenna group including a plurality of second antenna structures disposed on the carrier substrate, a second left conductive connecting element electrically connected to the second antenna structures, and a second right conductive connecting element electrically connected to the second antenna structures;

a front conductive connecting assembly including a first front conductive connecting element electrically connected to the first left conductive connecting element, a second front conductive connecting element electrically connected to the second left conductive connecting element, and a front signal feeding element electrically connected between the first front conductive connecting element and the second front conductive connecting element; and a rear conductive connecting assembly including a first rear conductive connecting element electrically connected to the first right conductive connecting element, a second rear conductive connecting element electrically connected to the second right conductive connecting element, and a rear signal feeding element electrically connected between the first rear conductive connecting element and the second rear conductive connecting element;

wherein the first antenna structure includes a first support element disposed on the carrier substrate, a first upper plate supported by the first support element, and a first lower plate supported by the first support element, the first upper plate and the first lower plate are separate from each other, and the first lower plate is connected between the first left conductive connecting element and the first right conductive connecting element;

wherein the second antenna structure includes a second support element disposed on the carrier substrate, a second upper plate supported by the second support element, and a second lower plate supported by the second support element, the second upper plate and the second lower plate are separate from each other, and the second lower plate is connected between the second left conductive connecting element and the second right conductive connecting element;

wherein the first left conductive connecting element includes two first left conductive portions, and the first right conductive connecting element includes two first right conductive portions;

wherein each of the first left conductive portions includes two first left straight sections, two first left bent sections and a first left offset section, the two first left bent sections are respectively connected to two adjacent ones of the first antenna structures, one of the two first left straight sections is connected between the first left offset section and one of the two first left bent sections, and another one of the two first left straight sections is connected between the first left offset section and another one of the two first left bent sections;

wherein each of the first right conductive portions includes two first right straight sections, two first right bent sections and a first right offset section, the two first right bent sections are respectively connected to another two adjacent ones of the first antenna structures, one of the two first right straight sections is connected between the first right offset section and one of the two first right bent sections, and another one of the two first right straight sections is connected between the first right offset section and another one of the two first right bent sections;

wherein the second left conductive connecting element includes two second left conductive portions, and the second right conductive connecting element includes two second right conductive portions;

wherein each of the second left conductive portions includes two second left straight sections, two second left bent sections and a second left offset section, the two second left bent sections are respectively connected to two adjacent ones of the second antenna structures, one of the two second left straight sections is connected between the second left offset section and one of the two second left bent sections, and another one of the two second left straight sections is connected between the second left offset section and another one of the two second left bent sections;

wherein each of the second right conductive portions includes two second right straight sections, two second right bent sections and a second right offset section, the two second right bent sections are respectively connected to another two adjacent ones of the second antenna structures, one of the two second right straight sections is connected between the second right offset section and one of the two second right bent sections, and another one of the two second right straight sections is connected between the second right offset section and another one of the two second right bent sections.

2. The arrayed antenna module according to claim 1, wherein the first left conductive connecting element includes a first left three-way connecting portion, one of the two first left conductive portions is electrically connected between two of the first antenna structures, another one of the two first left conductive portions is electrically connected between another two of the first antenna structures, and the first left three-way connecting portion is electrically connected between the two first left conductive portions and the first front conductive connecting element; wherein the first right conductive connecting element includes a first right three-way connecting portion, one of the two first right conductive portions is electrically connected between the two of the first antenna structures, another one of the two first right conductive portions is electrically connected between the another two of the first antenna structures, and the first right three-way connecting portion is electrically connected between the two first right conductive portions and the first rear conductive connecting element.

3. The arrayed antenna module according to claim 2, wherein the first left three-way connecting portion includes a first left three-way straight section and three first left widened sections each having a width larger than that of the first left three-way straight section, one of the three first left widened sections is connected to the first left three-way straight section and the first front conductive connecting element, another one of the three first left widened sections is connected to the first left three-way straight section and one of the two first left conductive portions, and the other one of the three first left widened sections is connected to the first left three-way straight section and another one of the two first left conductive portions; wherein the first right three-way connecting portion includes a first right three-way straight section and three first right widened sections each having a width larger than that of the first right three-way straight section, one of the three first right widened sections is connected to the first right three-way straight section and the first front conductive connecting element, another one of the three first right widened sections is connected to the first right three-way straight section and one of the two first right conductive portions, and the other one of the three first right widened sections is connected to the first right three-way straight section and another one of the two first right conductive portions.

4. The arrayed antenna module according to claim 1, wherein the second left conductive connecting element includes a second left three-way connecting portion, one of the two second left conductive portions is electrically connected between two of the second antenna structures, another one of the two second left conductive portions is electrically connected between another two of the second antenna structures, and the second left three-way connecting portion is electrically connected between the two second left conductive portions and the second front conductive connecting element; wherein the second right conductive connecting element includes a second right three-way connecting portion, one of the two second right conductive portions is electrically connected between the two of the second antenna structures, another one of the two second right conductive portions is electrically connected between the another two of the second antenna structures, and the second right three-way connecting portion is electrically connected between the two second right conductive portions and the second rear conductive connecting element.

5. The arrayed antenna module according to claim 4, wherein the second left three-way connecting portion includes a second left three-way straight section and three second left widened sections each having a width larger than that of the second left three-way straight section, one of the three second left widened sections is connected to the second left three-way straight section and the second front conductive connecting element, another one of the three second left widened sections is connected to the second left three-way straight section and one of the two second left conductive portions, and the other one of the three second left widened sections is connected to the second left three-way straight section and another one of the two second left conductive portions; wherein the second right three-way connecting portion includes a second right three-way straight section and three second right widened sections each having a width larger than that of the second right three-way straight section, one of the three second right widened sections is connected to the second right three-way straight section and the second front conductive connecting element, another one of the three second right widened sections is connected to the second right three-way straight section and one of the two second right conductive portions, and the other one of the three second right widened sections is connected to the second right three-way straight section and another one of the two second right conductive portions.

* * * * *